US006287395B1

(12) United States Patent
Schriever et al.

(10) Patent No.: US 6,287,395 B1
(45) Date of Patent: Sep. 11, 2001

(54) HIGH-ENERGY WELDABLE SOFT MAGNETIC STEEL AND ITS USE FOR PARTS OF MAGNETIC SUSPENSION RAILWAYS

(75) Inventors: Udo Schriever, Mülheim; Hans-Joachim Tschersich, Dorsten, both of (DE)

(73) Assignee: Thyssen Stahl AG, Duisburg (DE)

( * ) Notice: Subject to any disclaimer, the term of this patent is extended or adjusted under 35 U.S.C. 154(b) by 0 days.

(21) Appl. No.: 09/230,102

(22) PCT Filed: Aug. 5, 1997

(86) PCT No.: PCT/EP97/04245

§ 371 Date: Feb. 5, 1999

§ 102(e) Date: Feb. 5, 1999

(87) PCT Pub. No.: WO98/06882

PCT Pub. Date: Feb. 19, 1998

(30) Foreign Application Priority Data

Aug. 10, 1996 (DE) ..... 196 32 370

(51) Int. Cl.[7] ..... H01F 1/147

(52) U.S. Cl. ..... 148/307; 420/90; 420/93; 420/104; 420/118; 420/126; 420/128

(58) Field of Search ..... 148/306, 332, 148/333, 307; 420/90, 93, 104, 118, 126, 128

(56) References Cited

U.S. PATENT DOCUMENTS 4,091,147 * 5/1978 Kanazawa et al. ..... 428/683
4,388,122 * 6/1983 Sudo et al. .
4,537,644 * 8/1985 Tominaga et al. .

FOREIGN PATENT DOCUMENTS 2 071 149 A * 9/1981 (GB) .
08-041582-A * 2/1996 (JP) .

OTHER PUBLICATIONS

Baumgardt et al., "verbesserung der Zahighkeitseigenschaften in der Warmeeinflussone von SchweiBverbindungen aus Feikornbaustahlen", Thyssen Technische Berichte, pp. 42 to 48, Jun. 1996.*

Patent Abstracts of Japan, vol. 096, No. 006, Jun. 28, 1996 (Abstract of JP 08 041582 A cited above).*

"Effects of titanium on magnetic properties of semi–processed non–oriented electrical steel sheets," T. Nakayama et al., *Journal of Materials Science 32 (1997)*, pp. 1055–1059.

* cited by examiner

*Primary Examiner*—John Sheehan
(74) *Attorney, Agent, or Firm*—Proskauer Rose LLP

(57) ABSTRACT

A high-energy weldable soft magnetic steel with high toughness in the heat-affected zone of weld joints, high specific electric resistance to reduce eddy currents, aging resistance and weathering resistance comprises 0.65 to <1.0% chromium, >1.0 to 2.0% silicon, 0.25 to 0.55% copper, 0.003 to 0.008% nitrogen, 0.15 to <0.6% manganese, 0.02 to 0.07% aluminum$_{solu.}$, 0.01 to 0.02% titanium, 0 to 0.15% carbon, 0 to 0.045% phosphorus, the balance iron and unavoidable impurities.

6 Claims, 1 Drawing Sheet

HIGH-ENERGY WELDABLE SOFT MAGNETIC STEEL AND ITS USE FOR PARTS OF MAGNETIC SUSPENSION RAILWAYS

BACKGROUND OF THE INVENTION

The invention relates to a high-energy weldable soft magnetic steel with high toughness in the heat-affected zone of weld joints, high specific electric resistance to reduce eddy currents, aging resistance and weathering resistance as well as its use for part of magnetic suspension railways which absorb carrying, guiding or driving forces, in particular side guide rails.

During the welding of structural steels, a coarse-grained structure is produced in a narrow zone next to the melt line as a result of the thermal stress of the material, which impairs the toughness properties. The size of the grain and the width of the coarse-grain zone are influenced by the energy per unit length during welding. With the increase of the energy per unit length, the grain is increased in size and, as a result, the energy absorbed in notched bar impact work deteriorates. As on the one hand the economical aspects of the welding is increased with rising energy per unit length and on the other hand a high toughness of the heat-affected zone is desired for the security of the component, there is a high demand for steels which are weldable with high energy per unit length without any permitted loss of toughness in the heat-affected zone, "Thyssen Techn. Berichte" (Thyssen Technical Reports), Volume 1/85, pages 42 to 49.

During the production of fine-grain structural steels the influence of fine precipitations, which can impair the austenite grain growth have long been used. Nitrides, carbides and carbonitrides of niobium and titanium as well as aluminum nitrides prevent the growth of austenite grains by obstructing the grain boundary movement. In the case of thermal stress caused during the welding, most precipitations dissolve and thus become ineffective. Only titanium nitride remains stable even at temperatures up to over 1400° C. The effect of titanium nitrides on the obstruction of the austenite grain growth depends on their quantity, size and distribution. The dispersion of titanium nitrides is influenced by the content of titanium and nitrogen, as well as by the cooling conditions of the steel after the casting. Fine titanium nitride precipitations with a particle size of less than 0.020 $\mu$m originate at titanium contents of less than 0.03% and a titanium/nitrogen ratio of 2 to 3.4. Under this prerequisite, the most effective obstruction in the austenite grain growth during the welding is achieved.

Steels whose alloy content is adjusted to corrosion resistance and the magnetic properties cannot be welded with high energy per unit length without losses in toughness in the heat-affected zone. The present invention is therefore based on the object of providing a soft magnetic steel which, on the one hand, can be processed with high energy per unit length by high-energy welding without any loss in toughness and, on the other hand, fulfils the requirements concerning high specific electric resistance, resistance to aging and weathering.

SUMMARY OF THE INVENTION

This object is achieved in accordance with the invention by a steel with the following chemical composition (in mass per cent):

| | | | |
|---|---|---|---|
| 0.65 | to | <1.0% | chromium |
| >1.0 | to | 2.0% | silicon |
| 0.25 | to | 0.55% | copper |
| 0.003 | to | 0.008% | nitrogen |
| 0.15 | to | <0.6% | manganese |
| 0.02 | to | 0.07% | $aluminum_{soln.}$ |
| 0.01 | to | 0.02% | titanium |
| 0 | to | 0.15% | carbon |
| 0 | to | 0.045% | phosphorus |

balance iron and unavoidable impurities.

This steel preferably has the following composition:

| | | | |
|---|---|---|---|
| 0.75 | to | 0.85% | chromium |
| 1.6 | to | 1.8% | silicon |
| 0.25 | to | 0.35% | copper |
| 0.003 | to | 0.008% | nitrogen |
| 0.30 | to | 0.40% | manganese |
| 0.040 | to | 0.07% | $aluminum_{solu.}$ |
| 0.01 | to | 0.02% | titanium |
| 0.05 | to | 0.08% | carbon |
| 0.005 | to | 0.02% | phosphorus |

balance iron and unavoidable impurities.

The steel in accordance with the invention solves the problem. It fulfills, on the one hand, the analytical requirements for high-energy welding and, on the other hand, the high requirements placed on a material, for example, for bearing and guiding elements of magnetic suspension railways concerning high specific electric resistance, resistance to aging and weathering.

A soft magnetic steel of similar composition is known from DE 30 09 234 C2, but which is not suitable for high-energy welding, i.e. welding with high energy per unit length. High energy per unit length during the welding processing of these steels is of special commercial interest owing to the rapid welding speed in view of the long travel routes of the magnetic suspension railway.

The steel in accordance with the invention is produced by casting, rolling, normalizing, or by normalizing rolling and accelerated cooling. In order to fulfill the requirements concerning the suitability for the high-energy welding, the titanium content of the steel in accordance with the invention is fixed preferably at 0.01 to 0.02% and the nitrogen content to 0.005 to 0.008% with a titanium/nitrogen ratio of preferably 2 to 4. The most effective obstruction to the austenite grain growth during the welding with high heat introduction is achieved under this requirement.

As a result of the inventive alloying of a soft magnetic steel with titanium, the aforementioned improvement of the weldability is combined uniquely with a simultaneous high electric resistance. The high electric resistance ensures a low power consumption during the operation of the magnetic suspension railway by minimizing the eddy current losses.

The steel in accordance with the invention can be processed considerably more efficiently, and as a result of its outstanding electrical properties, causes lower eddy current losses under operating conditions.

As a result of its aforementioned profile of properties, the steel in accordance with the invention id highly suitable for parts of magnetic suspension railways which must absorb bearing, guiding or driving forces, such as lateral guide rails.

BRIEF DESCRIPTION OF THE DRAWING

The sole FIGURE graphically depicts the results of the notched bar impact bending test on steel samples in accordance with the present invention.

DETAILED DESCRIPTION OF THE INVENTION

Figure 1:
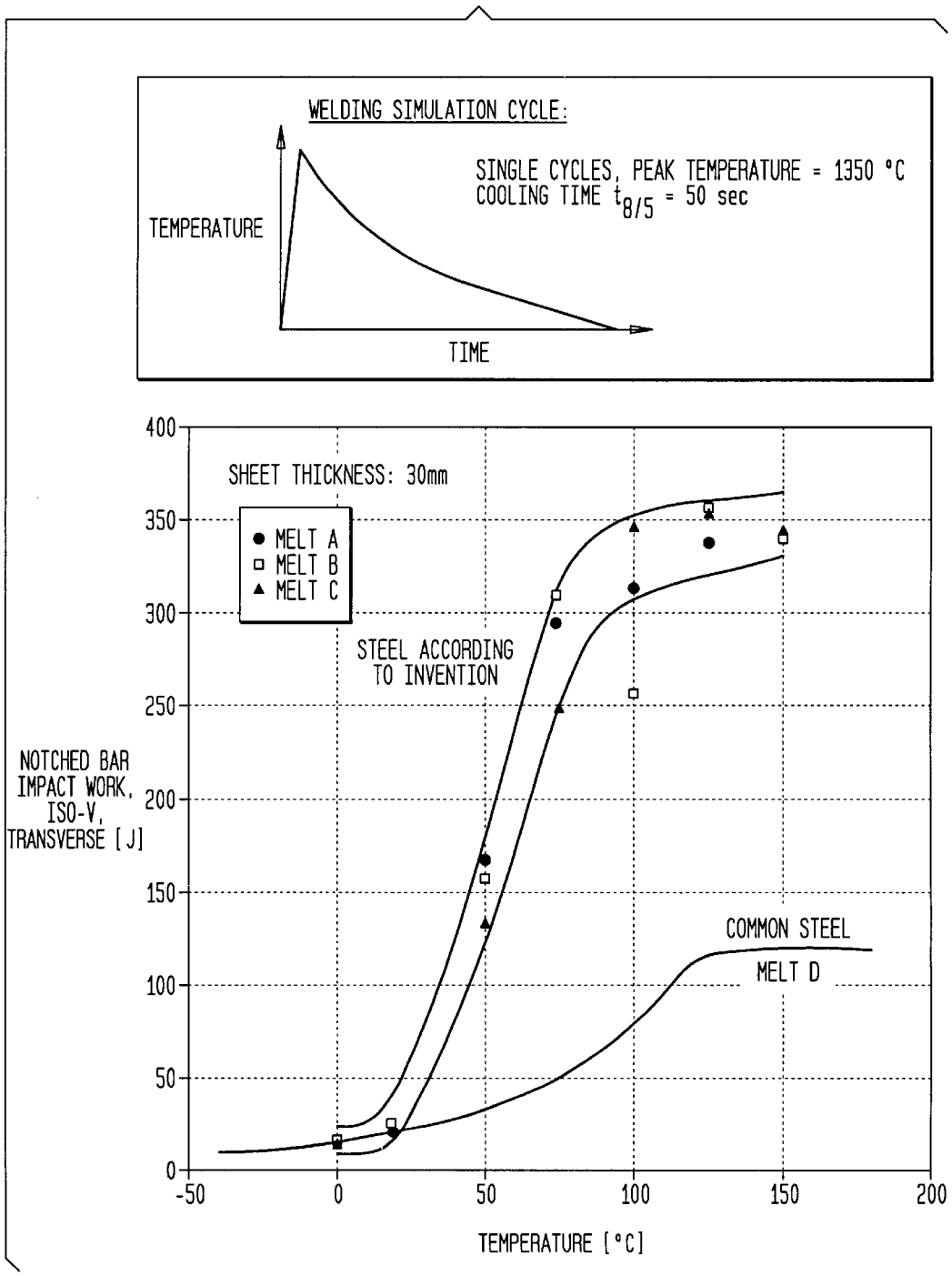

Examples for the steel in accordance with the invention are given in table 1.

TABLE 1

Chemical composition in mass %

| Steel | C | Si | Mn | P | S | N |
|---|---|---|---|---|---|---|
| A | 0.06 | 1.65 | 0.35 | 0.006 | 0.001 | 0.0065 |
| B | 0.06 | 1.69 | 0.39 | 0.007 | 0.002 | 0.0072 |
| C | 0.07 | 1.66 | 0.38 | 0.008 | 0.001 | 0.0069 |

| Steel | Al | Cr | Cu | Ti |
|---|---|---|---|---|
| A | 0.059 | 0.74 | 0.25 | 0.015 |
| B | 0.065 | 0.77 | 0.29 | 0.017 |
| C | 0.063 | 0.76 | 0.28 | 0.016 |

For the purpose of comparing the properties of the steel in accordance with the invention with a known steel without titanium pursuant to DE 30 09 234 C2, 30 mm sheet steels from the aforementioned melts were rolled and thereafter normalized. The steel D is composed of 0.07% C, 1.73% Si, 0.36% Mn, 0.013% P, 0.003% S, 0.006% N, 0.07% Al, 0.77% Cr, with the remainder being Fe.

The following summary in table 2 shows that the inventive steels A, B and C, as compared with the know steel D without titanium which is used for the comparison, have the same favorable magnetic and electric properties.

TABLE 2

Electric and magnetic properties

| | | Magnetic flux density in Tesla at 4000 A/m | Specific electric resistance at RT in $\Omega^*mm^2/m$ |
|---|---|---|---|
| Common steel | (D) | 1.60 | 0.399 |
| Steel in accordance with the invention | (A) | 1.64 | 0.384 |
| | (B) | 1.63 | 0.383 |
| | (C) | 1.65 | 0.384 |

The mechanical properties from tensile and notched bar impact bending tests are shown in table 3 by way of a comparison with the properties of the known steel D without titanium. Accordingly, the steels A, B and C in accordance with the invention also do not differ substantially with respect to their mechanical properties from the know steel D.

In order to examine the toughness in the heat-affected zone of a weld joints the structure of the heat-affected zone was simulated as is present immediately adjacent to the melt line. This simulation was made with a peak temperature of 1350° C. and a cooling time $t_{8/s}$=50 sec. The results of the notched bar impact bending test on the simulation samples are shown in the sole figure. The clear superiority of the steel in accordance with the invention can be seen in comparison with the comparative steel D without titanium.

TABLE 3

Comparison of mechanical properties

| Steel | A | B | C | D |
|---|---|---|---|---|
| Rel N/mm$^2$ | 360 | 370 | 355 | 363 |
| Rm/mm$^2$ | 537 | 539 | 534 | 529 |
| A % | 38 | 37 | 37 | 31 |
| Z % | 77 | 77 | 78 | — |
| Notched bar impact work (ISO-V) [J] | | | | |
| −20° C. | — | 13 | — | — |
| 0° C. | 12 | 57 | 13 | — |
| 10° C. | | | 117 | |
| 20° C. | 72 | 147 | 149 | 95 |
| 50° C. | 233 | 221 | 205 | |
| 100° C. | 275 | 294 | 281 | |
| 150° C. | 289 | 298 | 314 | |

Heat treatment: 10 min 950° C./AC
Sample position: transverse; ¼ sheet thickness As a result of the alloying with titanium it is possible to achieve a fundamental improvement of the weldability of the soft magnetic steel without impairing the favorable mechanical and magnetic properties.

What is claimed:

1. A soft magnetic steel suitable for high-energy welding with high toughness in a heat-affected zone of weld joints, high specific electric resistance to reduce eddy currents, aging resistance and weathering resistance comprises in mass %:

| | | | |
|---|---|---|---|
| 0.65 | to | <1.0% | chromium |
| >1.0 | to | 2.0% | silicon |
| 0.25 | to | 0.55% | copper |
| 0.003 | to | 0.008% | nitrogen |
| 0.15 | to | <0.6% | manganese |
| 0.02 | to | 0.07% | $aluminum_{soln.}$ |
| 0.01 | to | 0.02% | titanium |
| 0 | to | 0.15% | carbon |
| 0 | to | 0.045% | phosphorus |

balance iron and residual impurities.

2. A steel as claimed in claim 1, comprising in mass %:

| | | | |
|---|---|---|---|
| 0.75 | to | 0.85% | chromium |
| 1.6 | to | 1.8% | silicon |
| 0.25 | to | 0.35% | copper |
| 0.003 | to | 0.008% | nitrogen |
| 0.30 | to | 0.40% | manganese |
| 0.040 | to | 0.07% | $aluminum_{solu.}$ |
| 0.01 | to | 0.02% | titanium |
| 0.05 | to | 0.08% | carbon |
| 0.005 | to | 0.02% | phosphorus |

balance iron and residual impurities.

3. A steel as claimed in claim 1 having a titanium/nitrogen ratio of 2 to 4.

4. A steel as claimed in claim 2 having a titanium/nitrogen ratio of 2 to 4.

5. Magnetic suspension railways which absorb bearing, guiding or driving forces, made from the steel as claimed in claim 1.

6. Magnetic suspension railways which absorb bearing, guiding or driving forces, made from the steel as claimed in claim 2.

* * * * *